US007886716B1

(12) United States Patent
Arai et al.

(10) Patent No.: US 7,886,716 B1
(45) Date of Patent: Feb. 15, 2011

(54) CARBURETOR CONTROL SYSTEM

(75) Inventors: Tetsuya Arai, Wako (JP); Takanori Sato, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/556,218

(22) Filed: Sep. 9, 2009

(51) Int. Cl.
*F02D 31/00* (2006.01)
*F02M 3/00* (2006.01)

(52) U.S. Cl. ..... 123/400; 123/437; 123/376; 261/39.4

(58) Field of Classification Search ..... 123/399.1, 123/399, 400, 376; 261/39.4
See application file for complete search history.

(56) References Cited

U.S. PATENT DOCUMENTS 7,246,794 B2 * 7/2007 Suzuki et al. ..... 261/52
2006/0022359 A1 * 2/2006 Edamatsu et al. ..... 261/39.1

FOREIGN PATENT DOCUMENTS

JP 2006-242143 A 9/2006
JP 2009-180139 * 8/2009
JP 2009-180140 * 8/2009

* cited by examiner

*Primary Examiner*—Hai H Huynh
(74) *Attorney, Agent, or Firm*—Westerman, Hattori, Daniels & Adrian, LLP

(57) ABSTRACT

A carburetor control system includes: a governor device that is coupled to a throttle lever, opens a throttle valve when an operation of an engine is stopped, and opens or closes the throttle valve in accordance with a rotational number of the engine when the engine is in operation; a choke return spring urging a choke lever in a direction to close a choke valve; and an automatic choke device opening the choke valve in accordance with an increase in temperature of the engine. In the carburetor control system, the throttle lever is provided with a drive arm pivoting the choke lever, during a cold operation of the engine, to a position where the choke valve is at an intermediate degree of opening in operative connection with the throttle lever being pivoted by the governor device to a position where the throttle valve is at a degree of opening for idling or a position in a vicinity thereof. Accordingly, it is possible to mechanically open the choke valve to a predetermined intermediate degree of opening, when the engine is in a cold idling state, in operative connection with the throttle valve, so as to be capable of ensuring a fuel-efficient and stable idling state.

5 Claims, 14 Drawing Sheets

ENGINE STOP STATE

COLD IDLING STATE

WARM-UP IS COMPLETED (1)
(IDLING STATE)

WARM-UP IS COMPLETED (2)
(IDLING STATE)

CARBURETOR CONTROL SYSTEM

BACKGROUND OF THE INVENTION

1. Field of the Invention

The present invention relates mainly to a carburetor control system for a general-purpose engine, and relates especially to an improvement of a carburetor control system comprising: a governor device coupled to a throttle lever for opening and closing a throttle valve, the governor device opening the throttle valve when an operation of an engine is stopped, the governor device opening or closing the throttle valve in accordance with a rotational number of the engine when the engine is in operation; a choke return spring urging a choke lever for opening and closing a choke valve in a direction to close the choke valve; and an automatic choke device connected to the choke lever to open the choke valve in accordance with an increase in temperature of the engine.

2. Description of the Related Art

Such a carburetor throttle valve control system has already been known as disclosed in for example Japanese Patent Application Laid-open No. 2006-242143.

In such a conventional carburetor control system, the choke valve is controlled to a fully closed state by the automatic choke device when the engine is in a cold idling state. In addition, the carburetor is generally provided with a relief mechanism that opens the choke valve in accordance with an increase in the intake negative pressure generated downstream of the choke valve when the intake negative pressure reaches a predetermined value or more. Here, in the relief mechanism, it is desired that a set load of a relief spring is set as small as possible in order to facilitate the opening of the choke valve with the intake negative pressure, thereby preventing an excessive injection of fuel during cold idling of the engine. However, since the pulsation of the intake negative pressure is relatively strong when the engine is in an idling state, if the set load is set sufficiently small, the degree of opening of the choke valve becomes unstable due to the pulsation of the intake negative pressure. This being the situation, the reality is that the set load of the relief spring cannot be set sufficiently small. In this point, there is a room for improvement of the fuel efficiency of the engine.

SUMMARY OF THE INVENTION

The present invention is made in view of such circumstances, and aims to provide a carburetor control system that mechanically opens a choke valve to a predetermined intermediate degree of opening, when an engine is in a cold idling state, in operative connection with the closing of a throttle valve to a degree of opening for idling, so as to be capable of ensuring a fuel-efficient and stable idling state.

In order to achieve the object, according to a first feature of the present invention, there is provided a carburetor control system comprising: a governor device coupled to a throttle lever for opening and closing a throttle valve, the governor device opening the throttle valve when an operation of an engine is stopped, the governor device opening or closing the throttle valve in accordance with a rotational number of the engine when the engine is in operation; a choke return spring urging a choke lever for opening and closing a choke valve in a direction to close the choke valve; and an automatic choke device connected to the choke lever to open the choke valve in accordance with an increase in temperature of the engine, characterized in that the throttle lever is configured to pivot the choke lever, during a cold operation of the engine, to a position where the choke valve is at an intermediate degree of opening in operative connection with the throttle lever being pivoted by the governor device to a position where the throttle valve is at a degree of opening for idling or a position in a vicinity thereof.

According to the first feature of the present invention, after cold start of the engine, in operative connection with the throttle lever being pivoted to the position where the throttle valve is at the degree of opening for idling or a position in the vicinity thereof by the operation of the governor device, the choke lever is pivoted to the position where the choke valve is at the intermediate degree of opening. Thus, without being affected by the pulsation of the intake negative pressure, the amount of fuel injecting out from the fuel nozzle can stably be optimized by stabilizing the position where the choke valve is at the intermediate degree of opening, and a fuel-efficient and stable cold idling state of the engine can be ensured.

According to a second feature of the present invention, in addition to the first feature, the throttle lever is provided with a drive arm that pivots the choke lever, during the cold operation of the engine, to the position where the choke valve is at the intermediate degree of opening in response to the throttle lever being pivoted to the position where the throttle valve is at the degree of opening for idling or the position in the vicinity thereof, and the drive arm has an engagement surface formed therein, the engagement surface receiving frictional resistance due to an urging force of the choke return spring from the choke lever in a pivoting direction when the drive arm pivots the choke lever to the position where the choke valve is at the intermediate degree of opening.

According to the second feature of the present invention, when the engine is in a cold idling state, the drive arm of the throttle lever can pivot the choke lever to the position where the choke valve is at the intermediate degree of opening or a position in the vicinity thereof. Also, using the repulsive force of the choke return spring generated at this time, fluctuations of the throttle lever can be suppressed. Thus, the degree of opening of the throttle valve for idling can be stabilized to further stabilize the cold idling state of the engine.

Further, according to a third feature of the present invention, in addition to the second feature, the engagement surface is formed from an arc surface about a pivoting center of the throttle lever.

According to the third feature of the present invention, the repulsive force of the choke return spring can be used more effectively to reduce fluctuations of the throttle lever. Moreover, even when the throttle lever slightly pivots in the vicinity of the position where the throttle valve is at the degree of opening for idling, the choke valve can be maintained at the intermediate degree of opening.

According to a fourth feature of the present invention, in addition to the first feature, the choke lever is coupled to an outer end part of a valve shaft of the choke valve, the outer end part protruding upward from a carburetor body, the throttle lever is configured to pivot the choke lever, during the cold operation of the engine, to the position where the choke valve is at the intermediate degree of opening in operative connection with the throttle lever being pivoted by the governor device to the position where the throttle valve is at the degree of opening for idling or the position in the vicinity thereof, and an intermediate member pivotable relative to the choke lever is disposed between the choke lever and an upper surface of the carburetor body.

According to the fourth feature of the present invention, after cold start of the engine, in operative connection with the throttle lever being pivoted to the position where the throttle valve is at the degree of opening for idling or a position in the vicinity thereof by the operation of the governor device, the choke lever is pivoted to the position where the choke valve is at the intermediate degree of opening. Thus, without being affected by the pulsation of the intake negative pressure, the amount of fuel injecting out from the fuel nozzle can stably be optimized by stabilizing the position where the choke valve is at the intermediate degree of opening, and a fuel-efficient and stable cold idling state of the engine can be ensured.

Further, the intermediate member pivotable relative to the choke lever is disposed between the choke lever and the upper surface of the carburetor body, and the choke lever is separated from the upper surface of the carburetor body. Accordingly, in a cold condition, even if the freezing of rainwater or wash water adhering to the upper surface of the carburetor body causes the fixing of the intermediate member to the body, the pivoting of the choke lever is not inhibited. Thus, the throttle lever can reliably pivot the choke lever against the urging force of the choke return spring, thereby opening the choke valve to the intermediate degree of opening.

According to a fifth feature of the present invention, in addition to the fourth feature, the intermediate member is formed from a collar rotatably fitted to the valve shaft of the choke valve.

According to the fifth feature of the present invention, the collar as the intermediate member is supported between the carburetor body and the choke lever only by being fitted to the outer periphery of the valve shaft of the choke valve. Accordingly, the valve shaft of the choke valve is utilized for the supporting to eliminate the need for a special supporting member.

The above and other objects, characteristics and advantages of the present invention will be clear from detailed descriptions which will be provided below for the preferred embodiment while referring to the attached drawings.

DESCRIPTION OF THE PREFERRED EMBODIMENT

A preferred embodiment of the present invention will be described below based on the attached drawings.

Figure 1:
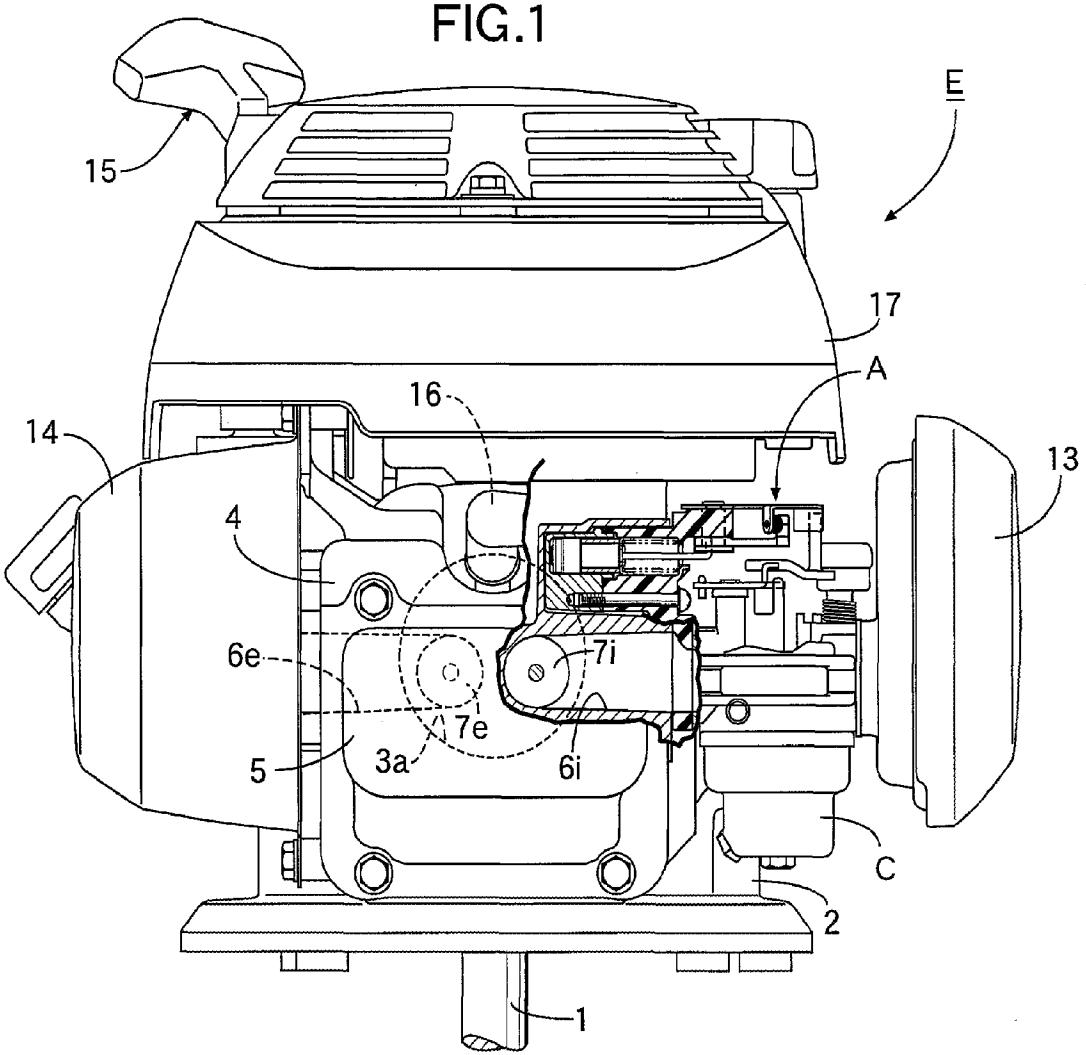
FIG. 1 is a front view of a general-purpose engine according to the present invention in which part is longitudinally sectioned.
Figure 2:
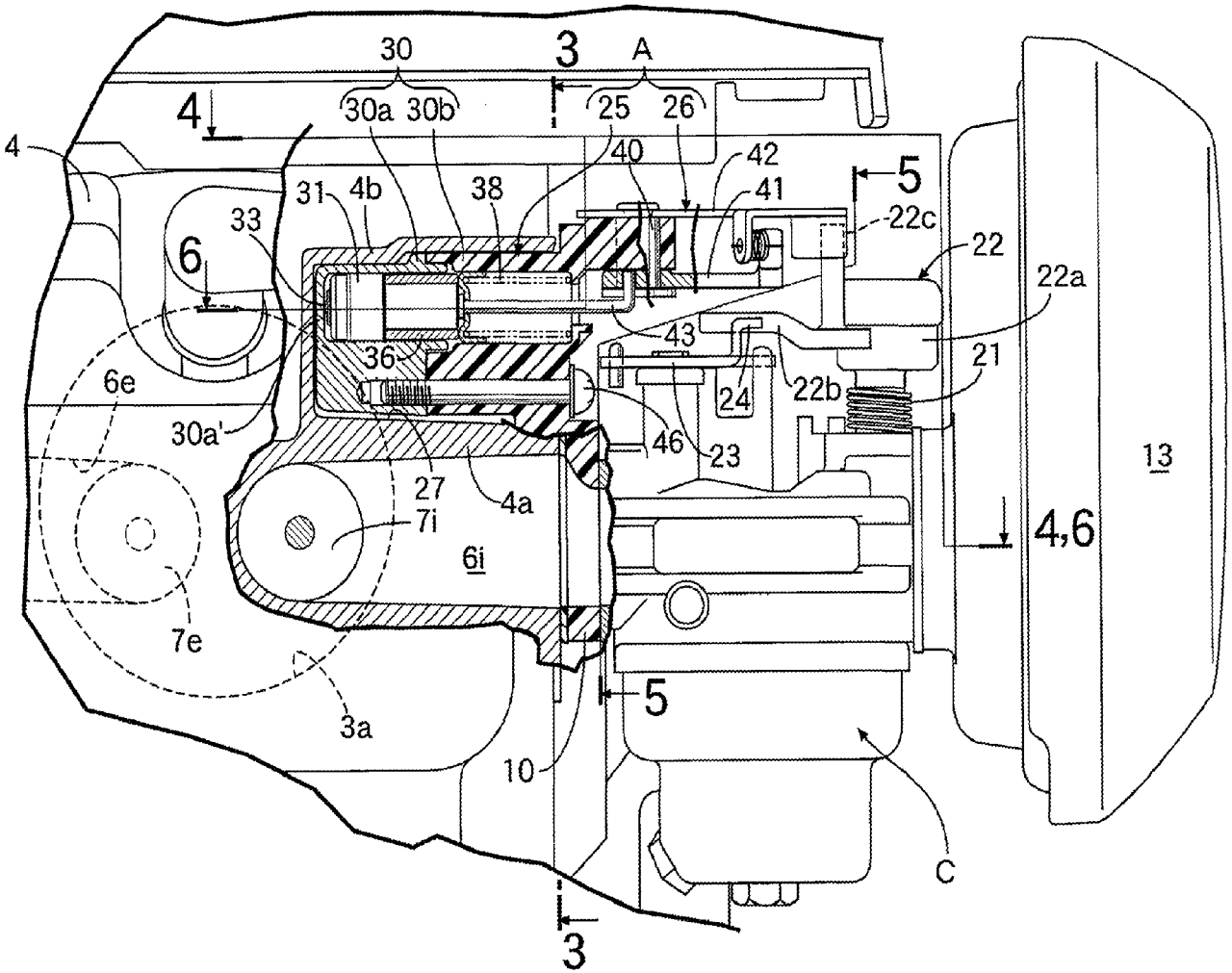
FIG. 2 is an enlarged view of an essential part in FIG. 1.
Figure 3:
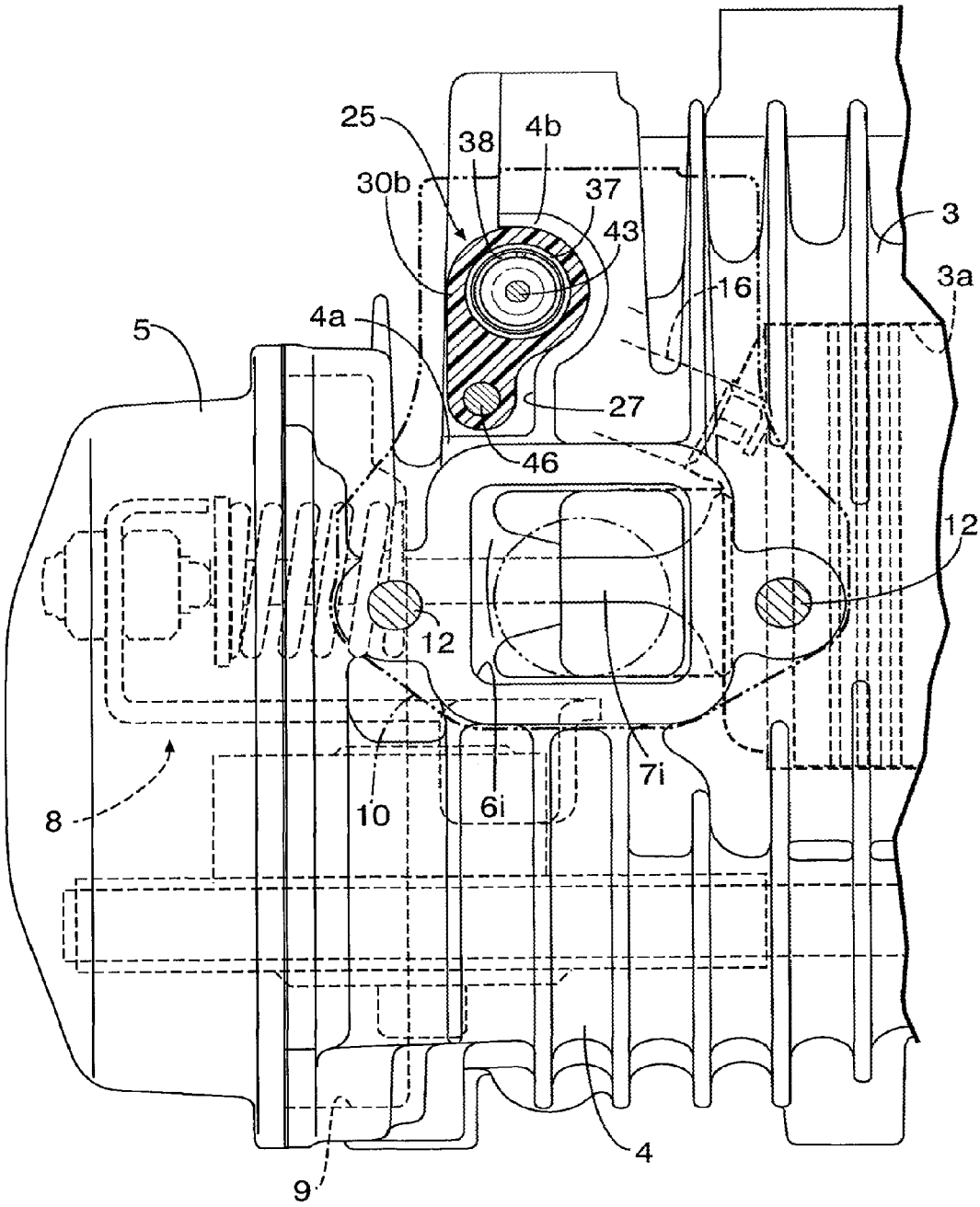
FIG. 3 is a sectional view taken along line 3-3 in FIG. 2.

Firstly, in FIG. 1 to FIG. 3, reference symbol E denotes a four-cycle engine, which is a power source for various types of work machine. This engine E includes: a crankcase 2 supporting a vertically disposed crankshaft 1; a cylinder block 3 projecting horizontally from the crankcase 2 and having a cylinder bore 3*a*; and a cylinder head 4 formed integrally with an outer end part of the cylinder block 3. The cylinder head 4 includes: an intake port 6*i* and an exhaust port 6*e* which are opened and closed by an intake valve 7*i* and an exhaust valve 7*e*, respectively; and a valve operating chamber 9 housing a valve operating mechanism 8 for operating the intake valve 7*i* and the exhaust valve 7*e*. A head cover 5 for closing the valve operating chamber 9 is joined to an end face of the cylinder head 4.

Outer ends of the intake port 6*i* and the exhaust port 6*e* open respectively on one side face and another side face, which face opposite directions to each other, of the cylinder head 4. A carburetor body Ca of a carburetor C is joined via a plurality of through bolts 12 to the one side face with a plate-shaped heat-insulating member 10 sandwiched therebetween. The carburetor body Ca includes an intake path 11 communicating with the intake port 6*i* of the cylinder head 4. The heat-insulating member 10 is made of a thermosetting synthetic resin such as a phenol resin having excellent thermal insulation, thereby suppressing heat conduction from the engine E to the carburetor C. An exhaust muffler 14 communicating with the exhaust port 6*e* is mounted on said another side face of the cylinder head 4. A fuel tank 17 and a recoil type starter 15 are disposed in an upper part of the engine E. Here, in FIG. 1, reference numeral 16 denotes a spark plug screwed into the cylinder head 4.

Figure 4:
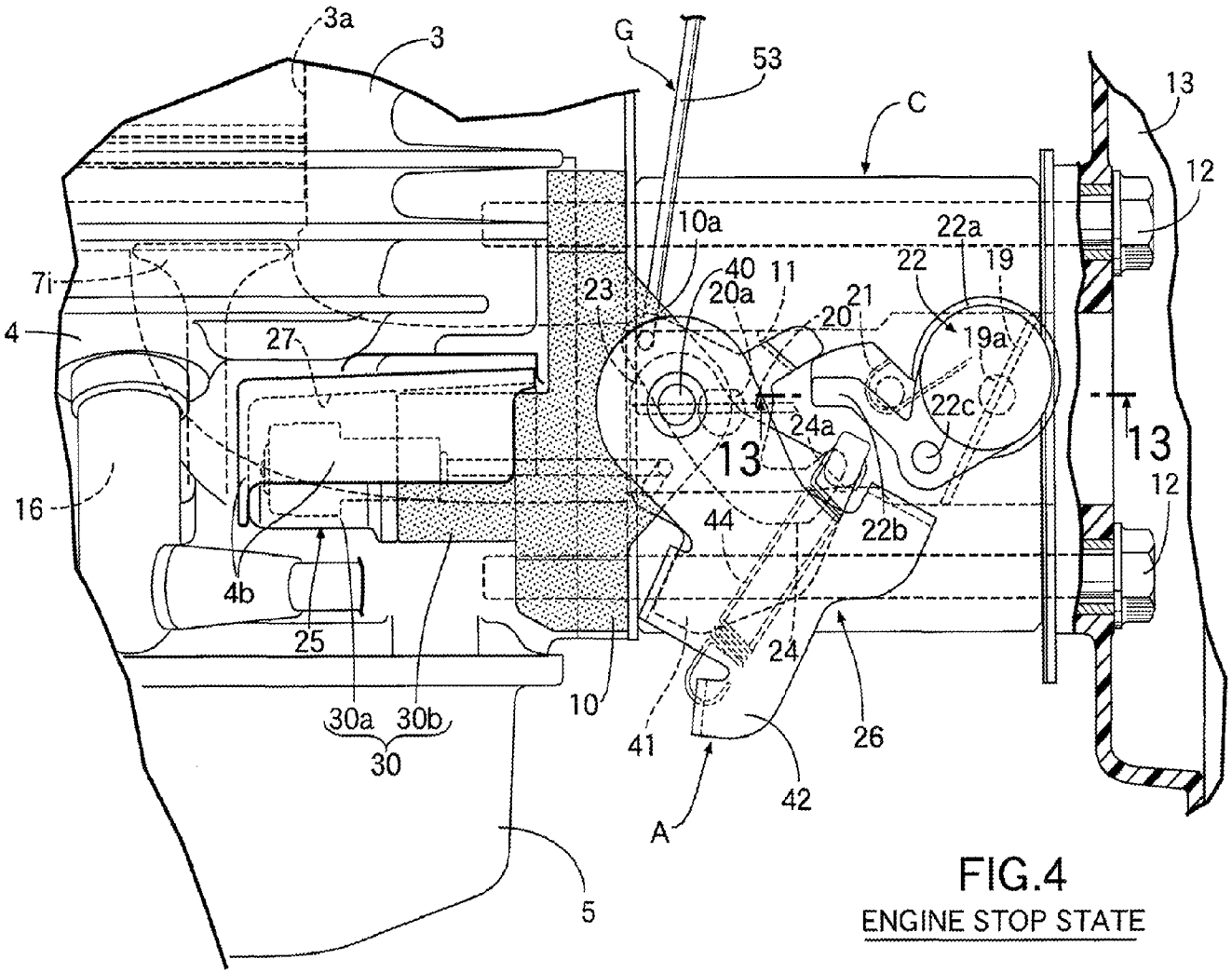
FIG. 4 is a sectional view taken along line 4-4 in FIG. 2.

As shown in FIG. 2 and FIG. 4, the carburetor C is attached with an air cleaner 13 that communicates with the upstream side of the intake path 11.

The carburetor C includes a choke valve 19 of a butterfly type for opening and closing an upstream portion of the intake path 11, a throttle valve 20 also of a butterfly type for opening and closing the downstream side thereof, and a fuel nozzle (not illustrated) that opens in an opening between the two valves 19 and 20. Both valve shafts 19*a* and 20*a* respectively of the choke valve 19 and the throttle valve 20 are rotatably supported in the carburetor body Ca in a vertical position.

As shown in FIGS. 4 and 13 to 15, the valve shaft 19*a* of the choke valve 19 is disposed offset to one side from the center line of the intake path 11. The choke valve 19 is inclined with respect to the center line of the intake path 11 so that, when the choke valve 19 is in a fully closed state, a side of the choke valve 19 having a larger radius is on the downstream side of the intake path 11 relative to a side thereof having a smaller radius. A choke lever 22 is mounted on an outer end part of the valve shaft 19*a* projecting upward from the carburetor body Ca. This choke lever 22 includes a closed-bottom cylindrical hub 22*a* rotatably fitted to the valve shaft 19*a*, and a lever arm 22*b* integrally provided on one side surface of this hub 22*a* in a protruding manner. Between a lower end surface of this hub 22*a* and an upper surface of the carburetor body Ca, a collar 61 is rotatably fitted to the outer peripheral surface of the valve shaft 19*a* so as to be allowed to rotating relative to the hub 22*a*. On the inner side of the hub 22*a*, a pair of stopper protrusions 62 and 62' are formed that are spiced at regular intervals in the peripheral direction of the hub 22*a*. A relief lever 63 pivotable only between these stopper protrusions 62 and 62' is fixed to the valve shaft 19*a*, and a relief spring 64 urging this relief lever 63 to bring the relief lever 63 into contact with one stopper protrusion 62 located on a side to close the choke valve 19 is provided between the hub 22*a* and the relief lever 63. The relief lever 63 and the relief spring 64 constitute a relief mechanism 60.

On the outer periphery of a lower portion of the hub 22*a*, a pair of stopper walls 65 and 65' are formed which are spaced at intervals in the peripheral direction. A stopper pin 66 placed between these stopper walls 65 and 65' is provided on the outer surface of the carburetor body Ca in a protruding manner.

Thus, a closed position C of the choke valve 19 is defined by one stopper wall 65 coming into contact with the stopper pin 66, and an open position O of the choke valve 19 is defined by the other stopper wall 65' coming into contact with the stopper pin 66. The choke lever 22 is urged toward the closed position C by the urging force of a choke return spring 21. The choke return spring 21 is formed from a torsion coil spring. A coil portion 21*a* thereof is disposed so as to surround the collar 61. One end portion 21*b* thereof is latched onto a latching pin 68 provided on the upper surface of the carburetor body Ca in a protruding manner, and the other end portion 21*c* thereof is latched onto the stopper wall 65 of the hub 22*a*.

When the choke valve 19 is fully closed or at a small degree of opening, if the intake negative pressure of the engine reaches a predetermined value or more, the difference between a rotational moment due to the intake negative pressure acting on the side of the choke valve 19 having a larger radius and a rotational moment due to the intake negative pressure acting on the side of the choke valve 19 having a smaller radius overcomes a rotational moment due to the relief spring 64, and increases the degree of opening of the choke valve 19. The increase of the degree of opening is restricted by the relief lever 63 coming into contact with the other stopper protrusion 62'.

To the lever arm 22*b* of the choke lever 22, an automatic choke device A is integrally connected, the automatic choke device automatically controlling the degree of opening of the choke valve 19 in accordance with a change in temperature of the engine E. This automatic choke device A will be described with reference to FIGS. 2 to 11.

Referring firstly to FIGS. 2 to 6, the automatic choke device A includes: a temperature sensitive section 25 that receives heat from the cylinder head 4 of the engine E, in particular the area around the intake port 6*i*; and an output section 26 that provides connection between the temperature sensitive section 25 and the lever arm 22*b*, and transmits a heat-receiving operation of the temperature sensitive section 25 to the choke lever 22 as a movement in a direction to open the choke valve 19. The temperature sensitive section 25 has a cylindrical housing 30 disposed in a housing chamber 27 formed in the cylinder head 4 from a peripheral wall 4*a* of the intake port 6*i* and a surrounding wall 4*b* rising up from an upper part of the peripheral wall 4*a* (see FIGS. 2 and 3). The housing chamber 27 has one end that opens, as an inlet, on one side face of the cylinder head 4 in the same manner as for the intake port 6*i*, and an end part on the opposite side facing the center of the cylinder head 4 is closed. Furthermore, one side of the housing chamber 27 is appropriately opened while taking into consideration the moldability of the surrounding wall 4*b* and the assemblability of the temperature sensitive section 25.

The housing 30 includes: a cup-shaped first portion 30*a* made of a metal having excellent thermal conductivity such as Al and having a base part 30*a'*; and a cylindrical second portion 30*b* that is made of a synthetic resin having excellent thermal insulation such as a phenol resin and that is fitted in a telescoping manner into an open end of the first portion 30*a* and connected thereto via a screw 46 (see FIG. 2). The second portion 30*h* is connected integrally to the heat-insulating member 10 disposed between the cylinder head 4 and the carburetor C. Therefore, the housing 30 is mounted on the cylinder head 4 without providing a member used exclusively for mounting.

The first portion 30*a* is disposed so that the base part 30*a'* faces the interior side of the housing chamber 27, that is, a central part (high temperature part) of the cylinder head 4, and the base part 30*a'* and the peripheral wall are in contact with an inner face of the housing chamber 27 or face it across a very small gap. The second portion 30*b* is disposed on the inlet side of the housing chamber 27, that is, the side away from the center of the cylinder head 4.

Figure 10:
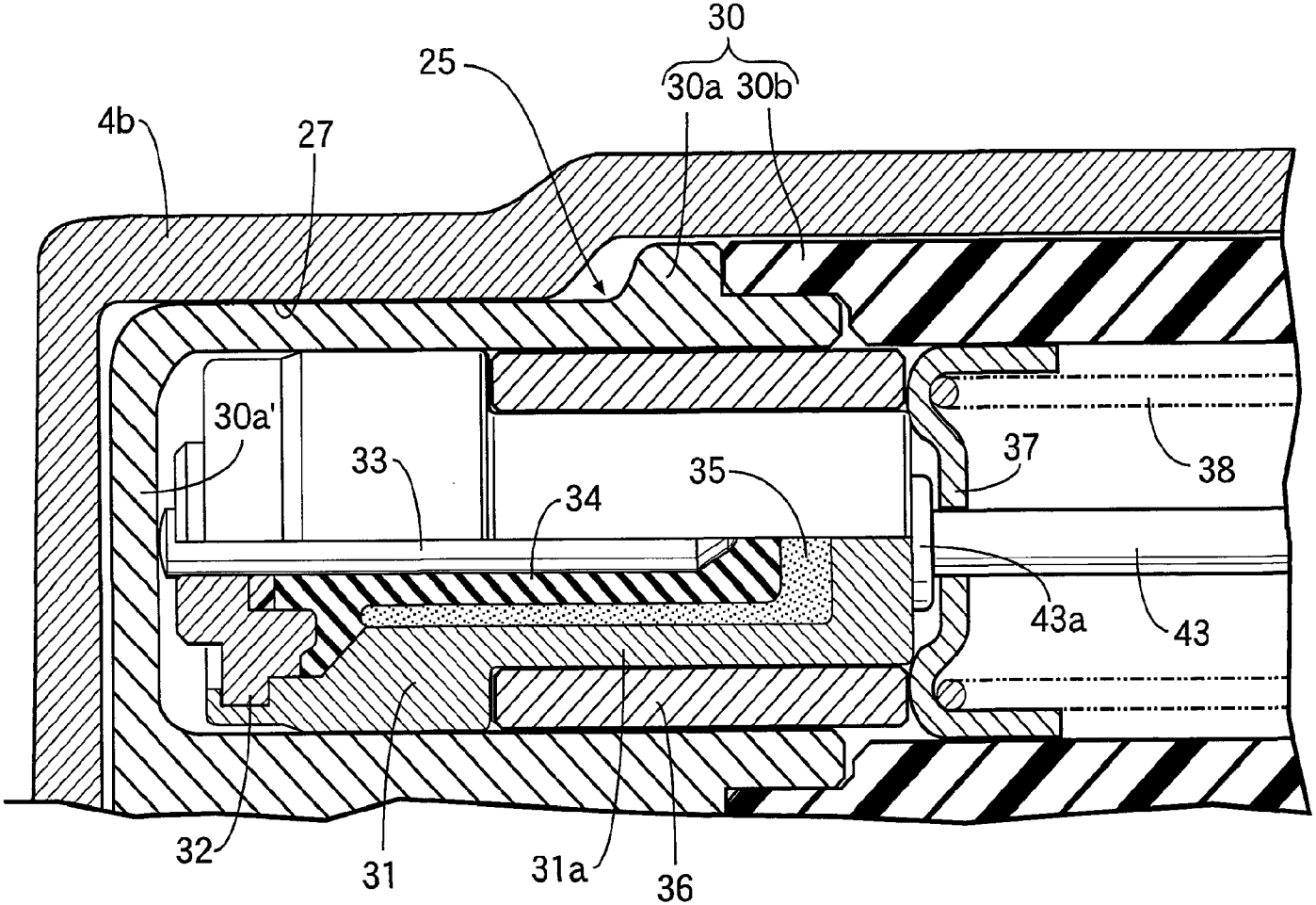
FIG. 10 is an enlarged view of a temperature sensitive section of the automatic choke device in FIG. 6.
Figure 11:
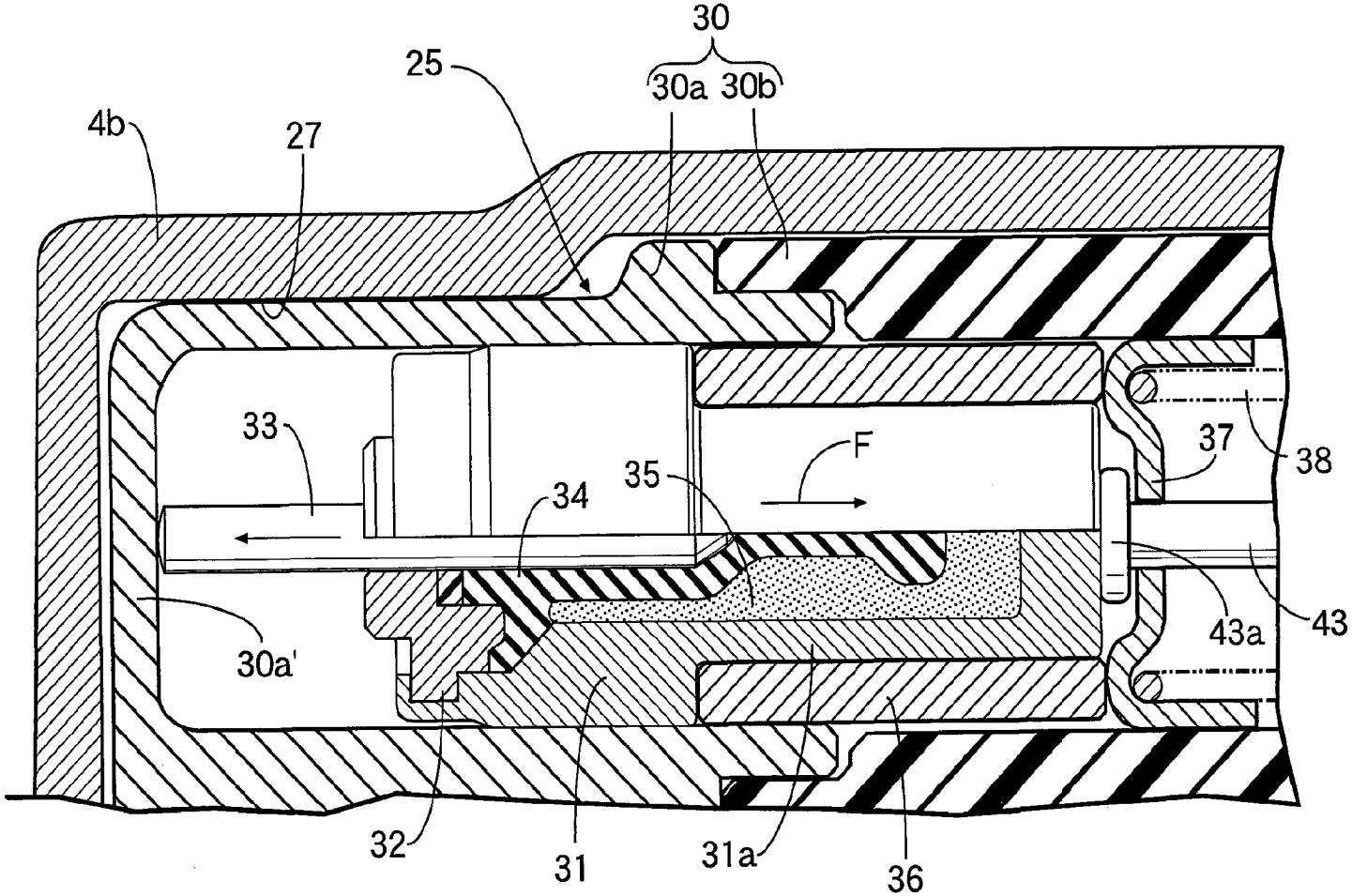
FIG. 11 is a diagram, corresponding to FIG. 10, for explaining the operation.

As shown in FIG. 10, the temperature sensitive section 25 includes: a bottomed movable cylinder 31 made of a metal having excellent thermal conductivity such as Al; a guide member 32 joined by crimping to an open end of the movable cylinder 31; a rod-shaped fixed piston 33 slidably supported in the guide member 32 and running therethrough; an elastic bag 34 having an open end held in a liquid-tight manner between the movable cylinder 31 and the guide member 32 while covering the fixed piston 33 within the movable cylinder 31; and wax 35 enclosed in the interior of the movable cylinder 31 so as to cover the elastic bag 34. The movable cylinder 31 is slidably fitted within the first portion 30*a* of the housing 30 in a state in which the outer end of the fixed piston 33 abuts against an inner face of the base part 30*a'* of the first portion 30*a* of the housing 30.

When the wax 35 is heated, it expands and compresses the elastic bag 34 so as to squeeze it, and consequently attempts to push the fixed piston 33 outside the guide member 32, but since the fixed piston 33 having the outer end abutting against the inner face of the base part 30*a'* of the first portion 30*a* is immovable, by virtue of the reaction thereof, the movable cylinder 31 advances within the first portion 30*a* in the direction of arrow F (see FIG. 11), that is, in a direction in which it moves away from the base part 30*a'*.

The half of the outer peripheral face of the movable cylinder 31 on the side opposite to the guide member 32 has a small diameter; a distance collar 36 is fitted around this smaller diameter part 31*a*, and a coil-shaped return spring 38 is provided under compression between the heat-insulating member 10 and a retainer 37 abutting against the distance collar 36, the return spring 38 urging, via the distance collar 36, the movable cylinder 31 toward the outer end of the fixed piston 33. Therefore, the retainer 37 is held between the distance collar 36 and the return spring 38.

Figure 5:
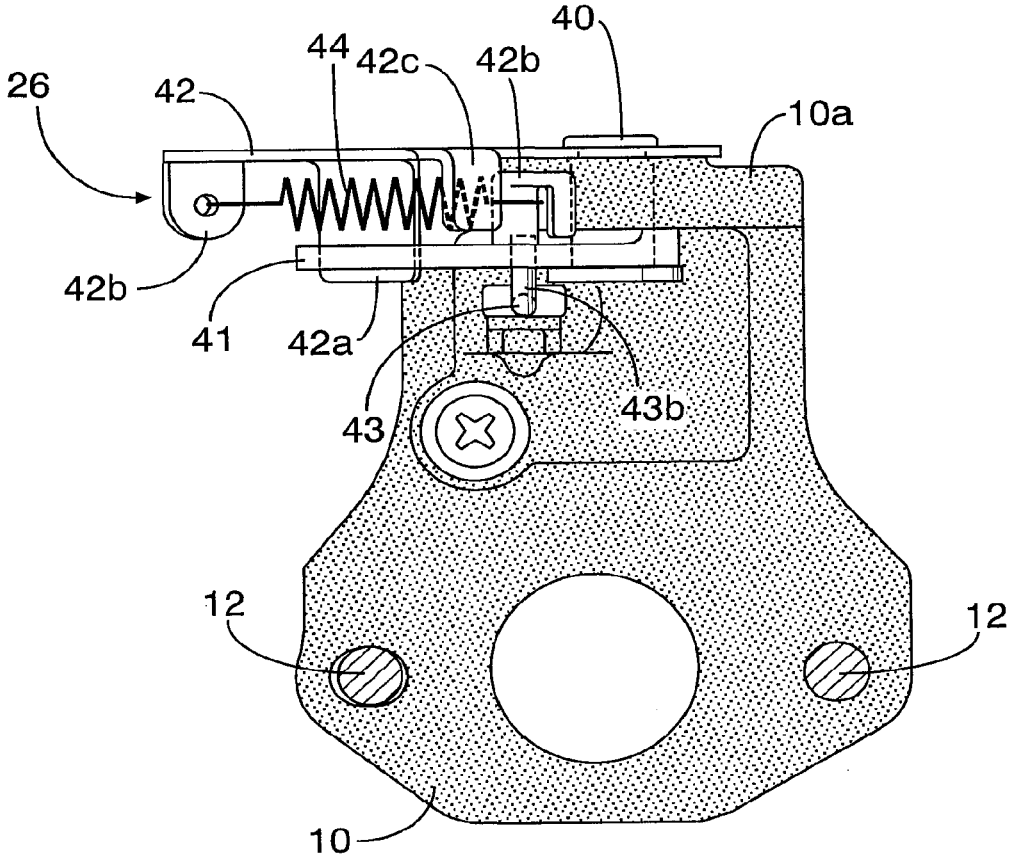
FIG. 5 is a sectional view taken along line 5-5 in FIG. 2.
Figure 6:
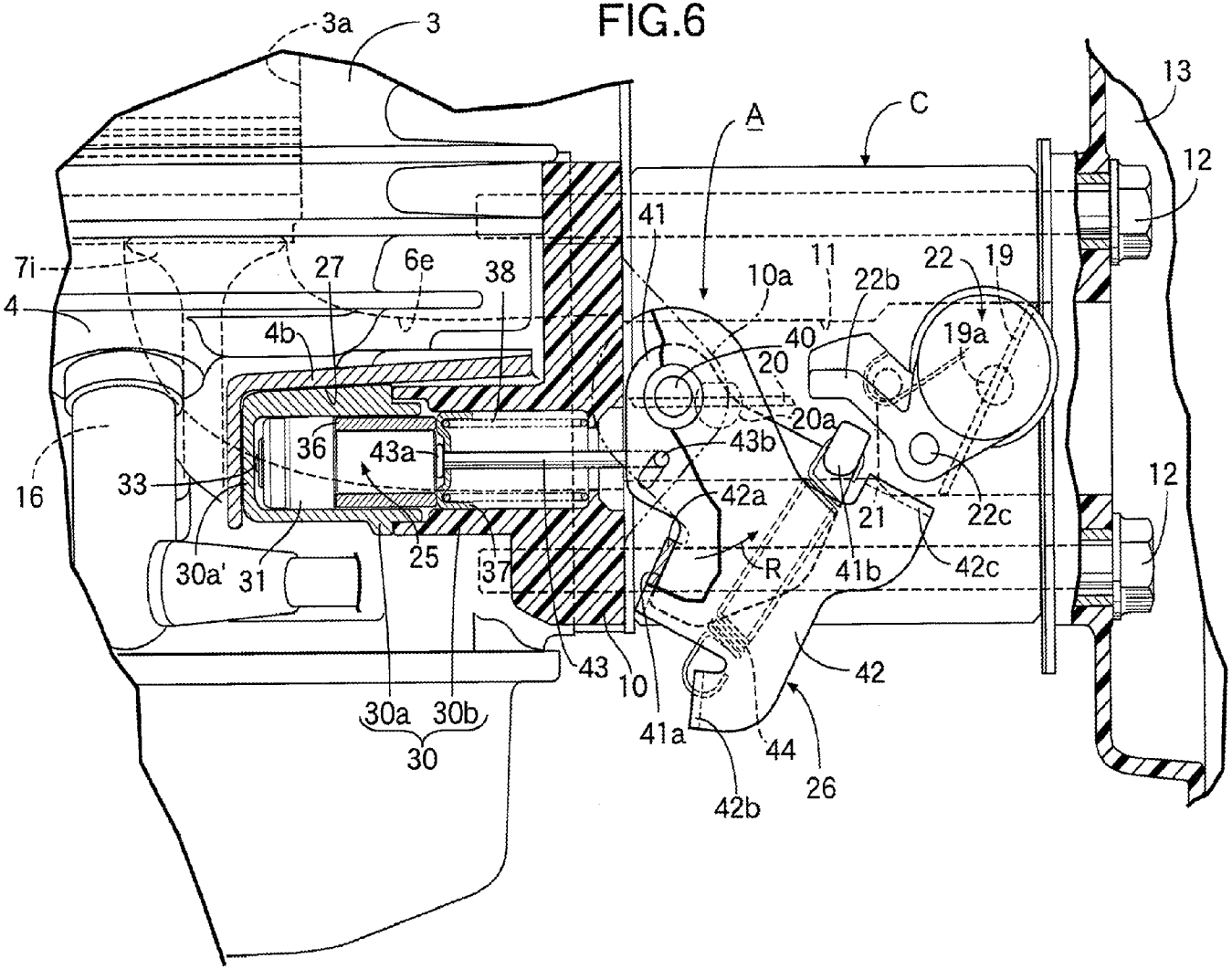
FIG. 6 is a sectional view taken along line 6-6 in FIG. 2.

As shown in FIGS. 5 and 6, the output section 26 includes: a rod 43 running through the heat-insulating member 10 and coupling one end part 43*a* to the retainer 37; and first and second levers 41 and 42 supported, via a common pivot 40, on opposite sides of a bracket 10*a* formed integrally with the heat-insulating member 10 so that they can pivot individually, another end part 43*b* of the rod 43 bent into an L shape being connected to the first lever 41, and it is arranged so that the first lever 41 pivots in the direction of arrow R in FIG. 6 as a result of axial movement of the rod 43 accompanying forward movement F of the movable cylinder 31. Coupling of the rod 43 to the retainer 37 is achieved by holding an enlarged end part 43*a* at one end of the rod 43 between the retainer 37 and an end face of the movable cylinder 31.

The first and second levers 41 and 42 have abutment parts 41*a* and 42*a* that separably abut against each other along the pivotal direction of the two, and these abutment parts 41*a* and 42*a* move away from each other when the first lever 41 pivots in the direction of the arrow R relative to the second lever 42. The first and second levers 41 and 42 are provided with spring latching parts 41*b* and 42*b*, and opposite ends of a coupling spring 44 are latched onto these spring latching parts 41*b* and 42*b*, the coupling spring 44 urging the two levers 41 and 42 in a direction in which the abutment parts 41*a* and 42*a* abut against each other.

Formed integrally with the second lever 42 is an operating arm 42*c* that operatively faces a follower pin 22*c* of the lever arm 22*b*. When the second lever 42 pivots in the direction of the arrow R, the operating arm 42*c* makes the choke lever 22 pivot in a direction to open the choke valve 19.

Figure 12:
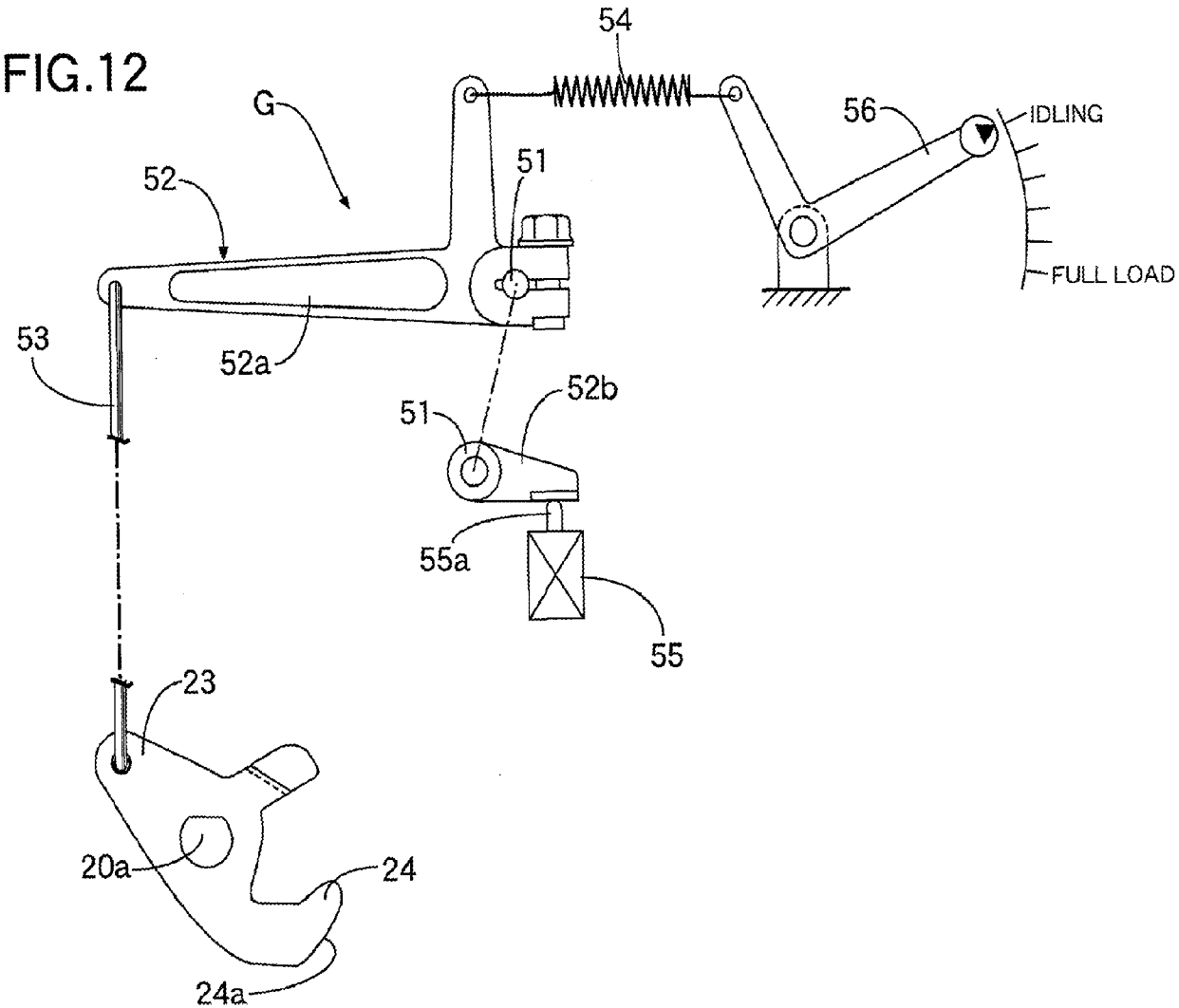
FIG. 12 is a schematic side view of a governor device.
Figure 13:
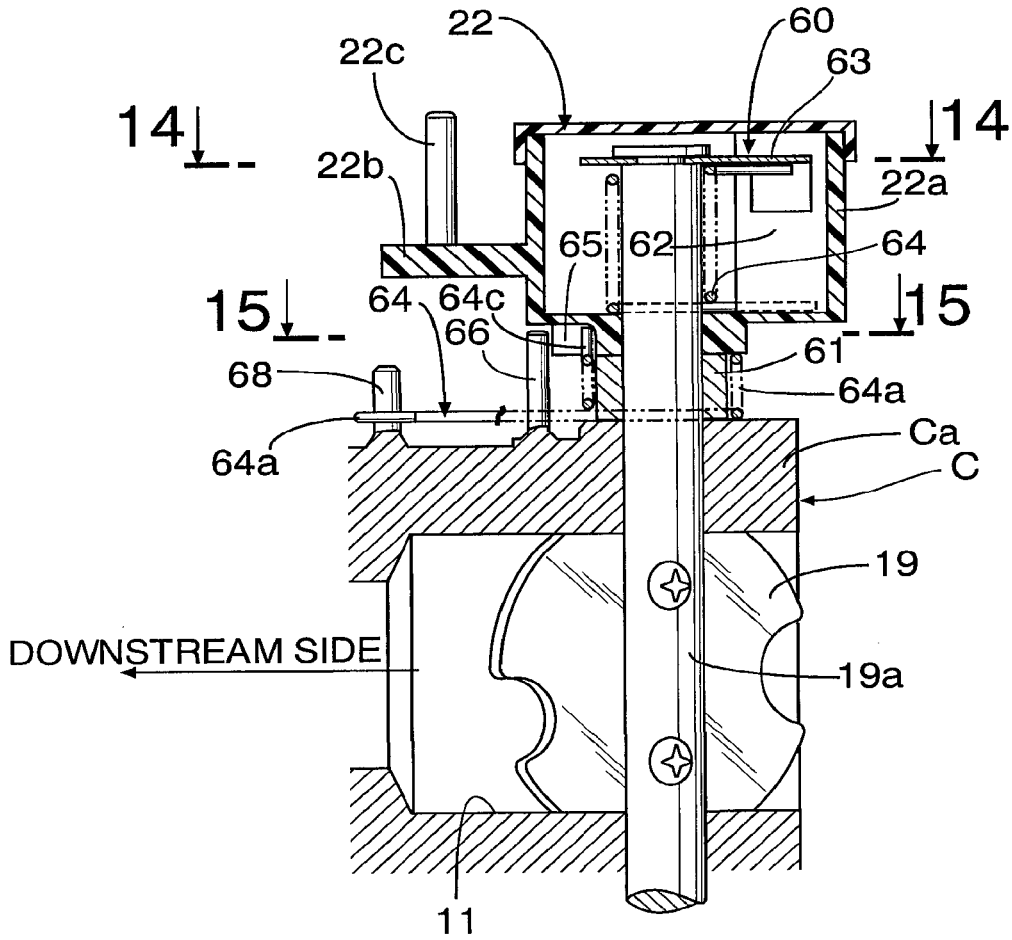
FIG. 13 is an enlarged sectional view taken along line 13-13 in FIG. 4.
Figure 14:
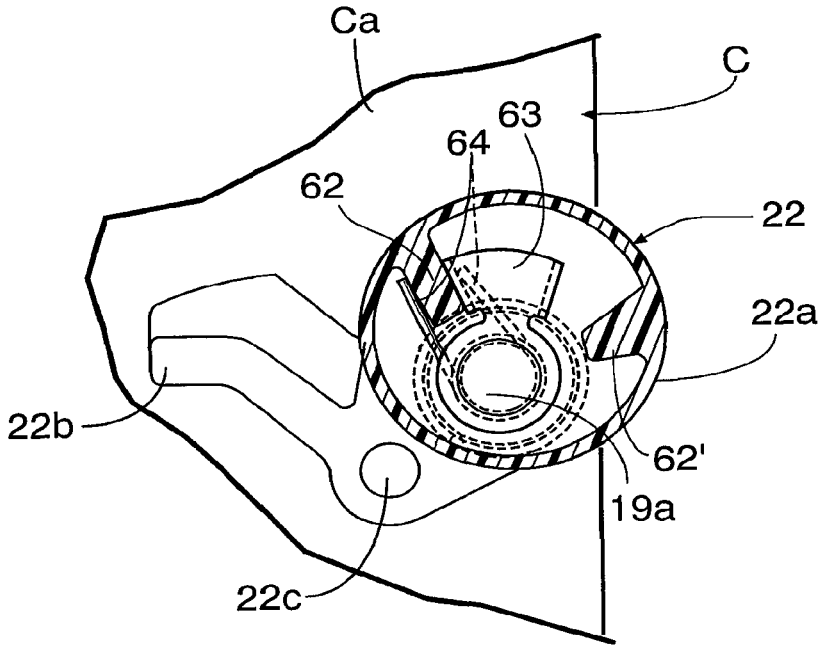
FIG. 14 is a sectional view taken along line 14-14 in FIG. 13.
Figure 15:
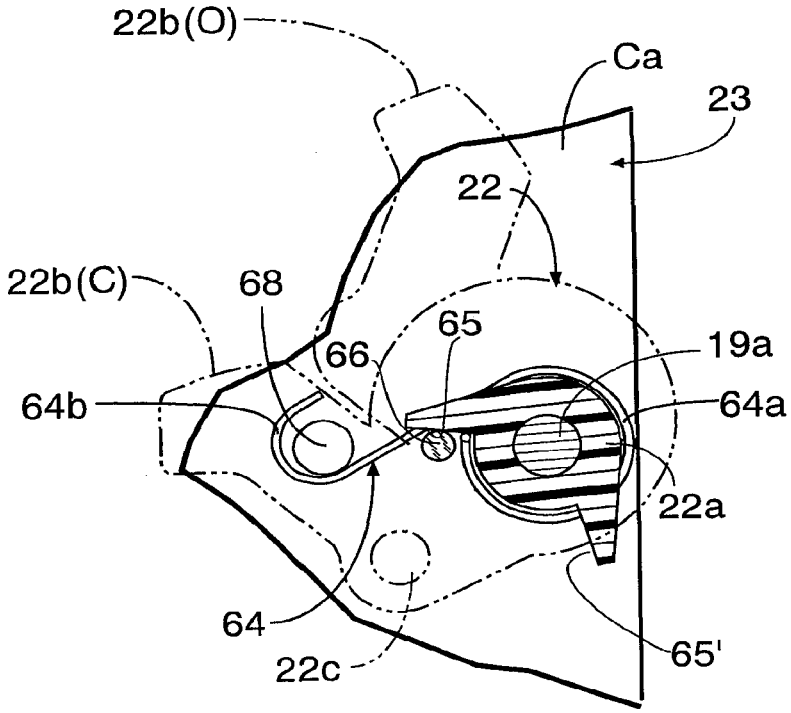
FIG. 15 is a sectional view taken along line 15-15 in FIG. 13.

In FIG. 12, a governor device G for automatically controlling opening and closing of the throttle valve 20 is explained. A throttle lever 23 is secured to an outer end part of the valve shaft 20*a* of the throttle valve 20. A governor lever 52 is secured to the outer end of a rotating support shaft 51 supported on the engine E. A long arm portion 52*a* of the governor lever 52 is coupled to the throttle lever 23 via a link 53. Furthermore, coupled via a governor spring 54 to the governor lever 52 is an output control lever 56 that is supported on the engine E, etc. and can pivot through a range from an idling position to a full load position. The governor spring 54 always urges the throttle valve 20 in the opening direction, and its spring load is increased and decreased by pivoting the output control lever 56 from the idling position to the full load position, or vice versa.

Further, an output shaft 55*a* of a known centrifugal governor 55 driven by the crankshaft 1 of the engine E is connected to a short arm portion 52*b* of the governor lever 52. The output of the centrifugal governor 55, which increases in response to an increase in the rotational number of the engine E, acts on the short arm portion 52*b* in a direction to close the throttle valve 20.

Therefore, in a state in which running of the engine E is stopped, the throttle lever 23 is held by means of a set load of the governor spring 54 at a position in which the throttle valve 20 is fully opened, but during running of the engine E, the degree of opening of the throttle valve 20 is automatically controlled by the balance between the moment of the governor lever 52 due to the output of the centrifugal governor 55 and the moment of the governor lever 52 due to the set load of the governor spring 54.

Figure 7:
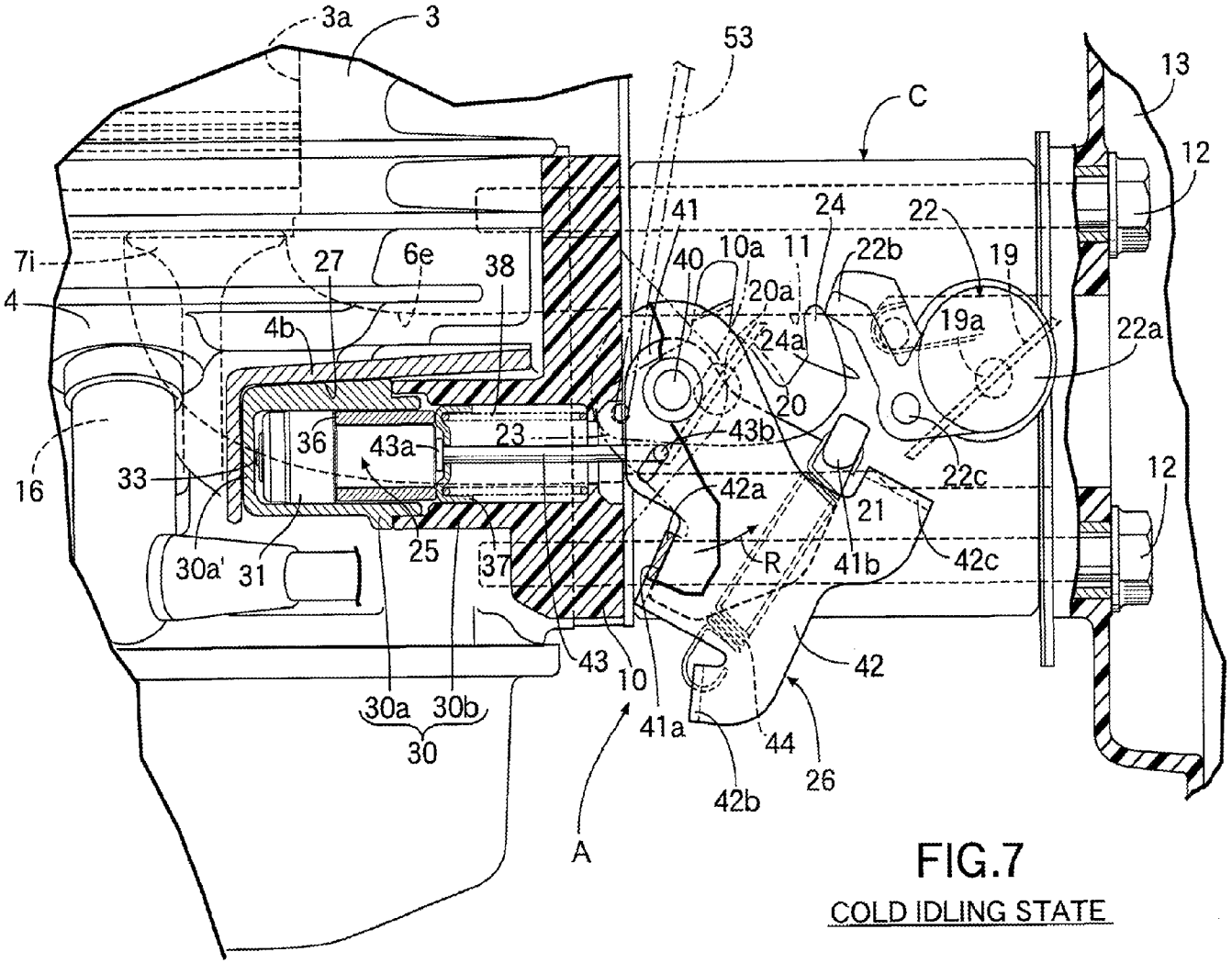
FIG. 7 is a diagram, corresponding to FIG. 6, for explaining the operation of an automatic choke device.

Moreover, as shown in FIGS. 4 and 7, a drive arm 24 protruding toward the choke lever 22 is formed integrally with the throttle lever 23. This drive arm 24 is configured to drive the lever arm 22*b* of the choke lever 22 to open the choke valve 19 from the fully closed position to a predetermined intermediate degree of opening when the throttle valve 20 is closed to the degree of opening for idling or a degree of opening close thereto. Further, the surface 24*a* of the drive arm 24 that engages the lever arm 22*b* is formed in the shape of an arc about the valve shaft 20*a* of the throttle valve 20 so that, when the throttle valve 20 is closed to the degree of opening for idling or a degree of opening close thereto, a tip end portion of the lever arm 22*b* is pushed toward the valve shaft 20*a* of the throttle valve 20 by the urging force of the choke return spring 21 to come into contact with the engagement surface 24*a*.

Next, the operation of this embodiment is explained.

In a state in which the engine E is cold or stopped, as shown in FIG. 10, since the wax 35 in the temperature sensitive section 25 is in a contracted state, the movable cylinder 31 is held at a retracted position in proximity to the base part 30*a*' of the first portion 30*a* of the housing 30 by means of the resilient force of the return spring 38. Accompanying this, as shown in FIG. 6, the operating arm 42*c* of the second lever 42 of the output section 26 is held at a position spaced from the lever arm 22*b* of the choke lever 22, and therefore the choke lever 22 is held at a position in which the choke valve 19 is closed by means of the urging force of the choke return spring 21.

On the other hand, the throttle valve 20 is held at a fully open position by the governor spring 54 since the centrifugal governor 55 is in an inoperative state (see FIGS. 4 and 6). If at this time the output control lever 56 is set at the idling position, the load of the governor spring 54 is set to a minimum.

Therefore, in order to start the engine E, if the recoil starter 15 is operated so as to crank the crankshaft 1, a large negative pressure is generated in the intake path 11 downstream of the choke valve 19 in the carburetor C, a relatively large amount of fuel spurts out from the fuel nozzle, which opens at this position, to make a gas mixture formed in the intake path 11 rich, thereby smoothly starting the engine E.

When the engine E is started, the centrifugal governor 55 generates an output corresponding to the rotational number of the crankshaft 1, so that the governor lever 52 pivots in a direction in which the moment of the governor lever 52 due to the above output balances the moment of the governor lever 52 due to the spring force of the governor spring 54. As shown in FIG. 7, the throttle valve 20 is closed to the degree of opening for idling by the throttle lever 23. In this process of closing the throttle valve 20, the drive arm 24 integrated with the throttle lever 23 pivots the lever arm 22*b* of the choke lever 22 in a direction to open the choke valve 19 against the urging force of the choke return spring 21. Thus, when the choke valve 19 is opened to a predetermined intermediate degree of opening (e.g., 30°), the tip end portion of the lever arm 22*b* comes into contact with the arc-shaped engagement surface 24*a* of the drive arm 24. As a result, as much air as needed to idle the engine E can be smoothly taken into the intake path 11 without depending on the operation of the relief mechanism 60, and the choke valve 19 can be prevented from fluctuating due to the pulsation of the intake negative pressure of the engine. It is possible to stabilize the injection of fuel while suppressing an excessive injection of fuel from the fuel nozzle. Accordingly, the gas mixture supplied to the engine can be regulated to have an air/fuel ratio appropriate for a cold idling state, so that the fuel efficiency of the engine E can be improved.

Also, in this state, the lever arm 22*b* is pushed by the repulsive force of the choke return spring 21 to come into contact with the engagement surface 24*a* of the drive arm 24 and, even fluctuations of the throttle lever 23 is suppressed by the frictional force generated therebetween. Accordingly, a more stabilized cold idling state of the engine can be obtained.

In particular, as described previously, the engagement surface 24*a* is formed from an arc surface about the valve shaft 20*a* of the throttle valve 20, and the tip end portion of the lever arm 22*b* is pushed toward the valve shaft 20*a* of the throttle valve 20 by the urging force of the choke return spring 21 to come into contact with the engagement surface 24*a*. Accordingly, fluctuations of the throttle lever 23 can effectively be suppressed by the frictional force generated in the contact portion. Also, even when the throttle lever 23 slightly pivots in the vicinity of the position where the throttle valve 20 is at the degree of opening for idling, the choke valve 19 can be maintained at the aforementioned intermediate degree of opening.

Incidentally, in a cold condition, rainwater or wash water staying on the upper surface of the carburetor body Ca may freeze. In such a case, if a lower surface of the choke lever 22 is in direct contact with the upper surface of the carburetor body Ca, the choke lever 22 would be fixed to the carburetor body Ca due to the above-described freezing, and the pivoting of the choke lever 22 by the drive arm 24 of the throttle lever 23 would be inhibited. However, the collar 61 pivotable relative to the hub 22*a* is disposed between the hub 22*a* of the choke lever 22 and the upper surface of the carburetor body Ca to prevent the choke lever 22 from coming into direct contact with the carburetor body Ca. Accordingly, even if rainwater or wash water adhering to the upper surface of the carburetor body Ca freezes, only the collar 61 is fixed, and the choke lever 22 can be prevented from being fixed. Thus, after the starting up of the engine E, in the process of closing the throttle valve 20 to the degree of opening for idling by the throttle lever 23, the drive arm 24 can reliably pivot the choke lever 22 against the urging force of the choke return spring 21, thus opening the choke valve 19 to a predetermined intermediate degree of opening. Also, the collar 61 is supported between the carburetor body Ca and the choke lever 22 only by being fitted to the outer periphery of the valve shaft 19*a* of the choke valve 19. Accordingly, the valve shaft 19*a* of the choke valve 19 is utilized for the supporting to eliminate the need for a special supporting member.

Next, when the output control lever 56 is pivoted from the idling position to an appropriate load position in order to impose a load of a work machine, etc. on the engine E, the load on the governor spring 54 increases accordingly, so that the degree of opening of the throttle valve 20 when the load on the governor spring 54 and the output of the centrifugal governor 55 are in balance therefore increases. When a degree of opening of the throttle valve 20 increases beyond the degree of opening for idling, the drive arm 24 of the throttle lever 23 is released from the pressing force of the lever arm 22*b* of the choke lever 22. However, since the rotational number of the engine increases to become stabilized, the operation of the centrifugal governor 55 also becomes stabilized, and the throttle lever 23 is also prevented from fluctuating.

Moreover, an increase in the amount of intake air accompanying an increase in the degree of opening of the throttle valve 20 also stabilizes the intake negative pressure generated downstream of the intake path 11. When the intake negative pressure exceeds a predetermined value, the choke valve 19 is opened until the difference between the rotational moment due to the intake negative pressure acting on the side of the choke valve 19 having a larger rotational radius and the rotational moment due to the intake negative pressure acting on the side of the choke valve 19 having a smaller rotational radius balances the rotational moment due to the relief spring 64 within the choke lever 22. Therefore, it is possible to suppress an excessive injection of fuel from the fuel nozzle and prevent the gas mixture formed in the intake path 11 from becoming too rich, thus guaranteeing good warm-up operating conditions. At this stage, since the intake negative pressure becomes relatively stable with an increase in the amount of intake air as described previously, the choke valve 19 never fluctuate, though the choke valve 19 is not forced to open by the drive arm 24 of the throttle lever 23.

When the temperature of the cylinder head 4 increases accompanying progress in the warming up of the engine E, the temperature sensitive section 25 within the housing chamber 27 in the proximity of the intake port 6*i* is heated via an inner wall of the housing chamber 27; as described above, the reaction to the elastic bag 34 being constricted to push out the fixed piston 33 due to thermal expansion of the wax 35 within the movable cylinder 31, makes the movable cylinder 31 move forward in the direction of the arrow F against the resilient force of the return spring 38; and this forward movement of the movable cylinder 31 pivots the first lever 41 via the rod 43 in the direction of the arrow R. Since this first lever 41 and the second lever 42 are initially in a coupled state in which the abutment parts 41*a* and 42*a* abut against each other due to the urging force of the coupling spring 44, as shown in FIG. 7, the second lever 42 also pivots integrally with the first lever 41, and the operating arm 42*c* makes the follower pin 22*c*, that is, the choke lever 22, pivot against the urging force of the choke return spring 21 in a direction that opens the choke valve 19. Therefore, since the degree of opening of the choke valve 19 increases in response to an increase in the temperature of the housing chamber 27, the negative pressure above the fuel nozzle within the intake path 11 is decreased accompanying progress in the warming up of the engine E, the amount of fuel spurting out from the fuel nozzle is decreased, and the air/fuel ratio of the gas mixture formed in the intake path 11 can be appropriately corrected. About time when the warming up of the engine E is completed, the temperature of the interior of the housing chamber 27 is sufficiently high, and as shown in FIG. 8, the choke valve 19 is controlled so as to be in a fully open state.

Figure 8:
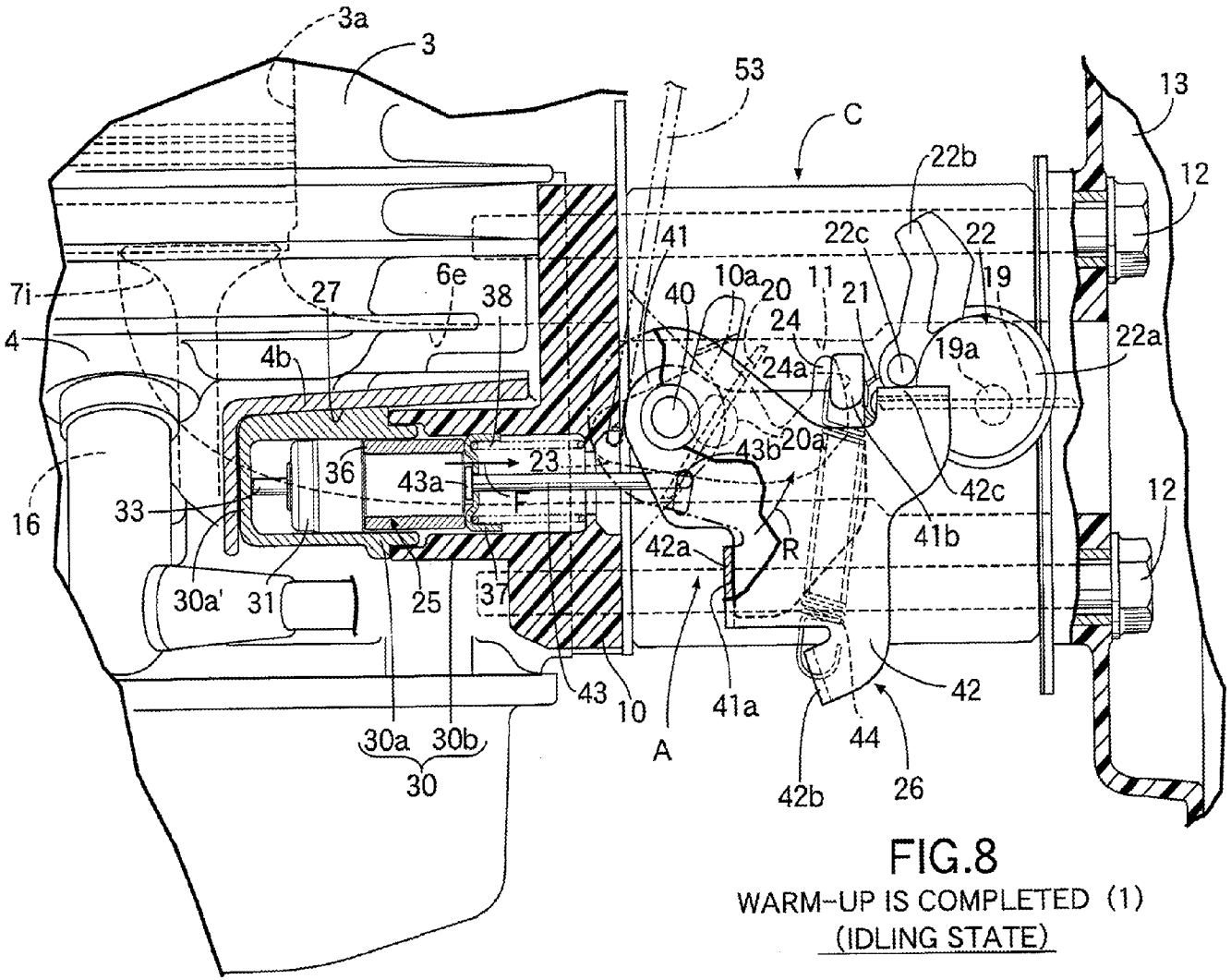
FIG. 8 is an another diagram for explaining the operation of the automatic choke device.

As hereinbefore described, when the choke valve 19 is opened by the choke lever 22, the choke lever 22 moves away from the drive arm 24 of the throttle lever 23 as shown in FIG. 8, and the two levers 22 and 23 do not interfere with each other. Therefore, if the output control lever 56 is returned to the idling position to control the load of the governor spring 54 at a minimum after the warming up is completed, the throttle lever 23 can be pivoted to the degree of opening for idling of the throttle valve 20 by means of the output of the centrifugal governor 55 without the interference of the choke lever 22.

Figure 9:
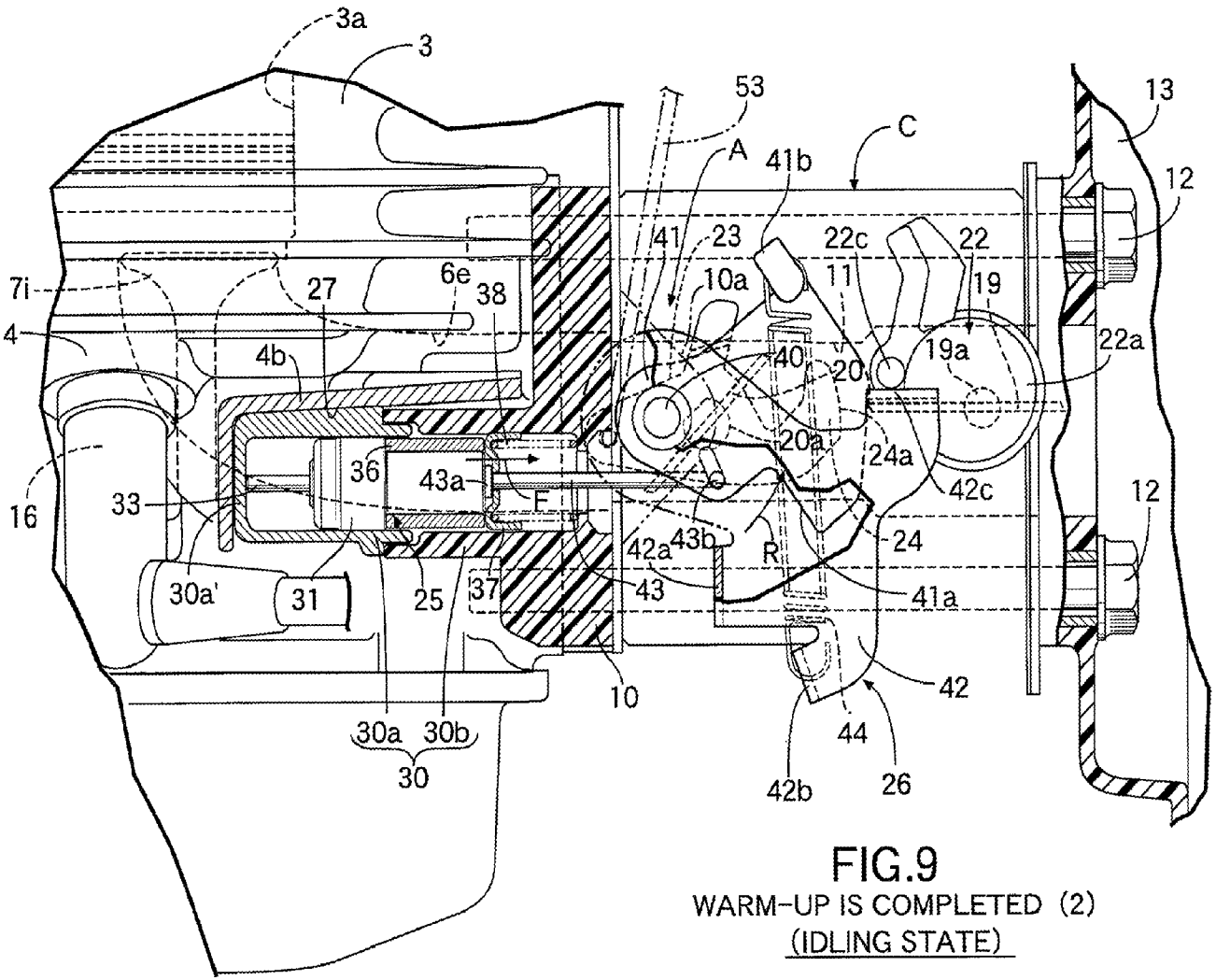
FIG. 9 is a vet another diagram for explaining the operation of the automatic choke device.

When the temperature of the cylinder head 4 further increases and the temperature of the housing chamber 27 increases, the wax 35 further thermally expands, and the movable cylinder 31 moves forward excessively to thus further pivot the first lever 41 in the direction of the arrow R via the rod 43. However, since further pivoting of the second lever 42 is inhibited by the choke lever 22 at the fully open position, as shown in FIG. 9, the first lever 41 alone pivots in the direction of the arrow R while stretching the coupling spring 44, and the abutment part 41*a* of the first lever 41 moves away from the abutment part 42*a* of the second lever 42. Therefore, an over stroke operation of the movable cylinder 31 of the temperature sensitive section 25 is absorbed by the stretching of the coupling spring 44. This means that each section from the automatic choke device A to the choke valve 19 is not applied by a load that is higher than the set load of the coupling spring 44, thereby avoiding the occurrence of excessive stress in each section to secure the durability of each section. Moreover, since the first and second levers 41 and 42, which can pivot relative to each other, are mounted on the bracket 10*a* via the common pivot 40, it is possible to reduce the number of components of the output section 26, thus simplifying the structure.

When running of the engine E is subsequently stopped, as long as a high temperature state of the engine E continues, the interior of the housing chamber 27 is also kept in a high temperature state, and therefore the temperature sensitive section 25 maintains a state in which the movable cylinder 31 is moved forward, thus maintaining the choke valve 19 in an open state via the output section 26. Accordingly, when the engine E in a high temperature state is restarted, it is possible to secure an open state of the choke valve 19, prevent the gas mixture from becoming too rich, and achieve good restarting properties.

After running of the engine E is stopped, when it becomes cool, the movable cylinder 31 retracts in the temperature sensitive section 25 as a result of thermal contraction of the wax 35 and the action of the return spring 38. Therefore, the output section 26 allows pivoting of the choke lever 22 by means of the choke return spring 21 in a direction that closes the choke valve 19.

The present invention is not limited to the above-mentioned embodiment, and various design modifications can be made thereto without departing from the gist thereof. For example, instead of the centrifugal governor device G, an electronic governor device or other type of governor device may be provided. Instead of the wax-type automatic choke device A, an electrothermal automatic choke device or other type of automatic choke device may be provided.

The invention claimed is:

1. A carburetor control system comprising:

a governor device coupled to a throttle lever for opening and closing a throttle valve, the governor device opening the throttle valve when an operation of an engine is stopped, the governor device opening or closing the throttle valve in accordance with a rotational number of the engine when the engine is in operation;

a choke return spring urging a choke lever for opening and closing a choke valve in a direction to close the choke valve; and an automatic choke device connected to the choke lever to open the choke valve in accordance with an increase in temperature of the engine, characterized in that the throttle lever is configured to pivot the choke lever, during a cold operation of the engine, to a position where the choke valve is at an intermediate degree of opening in operative connection with the throttle lever being pivoted by the governor device to a position where the throttle valve is at a degree of opening for idling or a position in a vicinity thereof.

2. The carburetor control system according to claim 1, wherein the throttle lever is provided with a drive arm that pivots the choke lever, during the cold operation of the engine, to the position where the choke valve is at the intermediate degree of opening in response to the throttle lever being pivoted to the position where the throttle valve is at the degree of opening for idling or the position in the vicinity thereof, and the drive arm has an engagement surface formed therein, the engagement surface receiving frictional resistance due to an urging force of the choke return spring from the choke lever in a pivoting direction when the drive arm pivots the choke lever to the position where the choke valve is at the intermediate degree of opening.

3. The carburetor control system according to claim 2, wherein the engagement surface is formed from an arc surface about a pivoting center of the throttle lever.

4. The carburetor control system according to claim 1, wherein the choke lever is coupled to an outer end part of a valve shaft of the choke valve, the outer end part protruding upward from a carburetor body, the throttle lever is configured to pivot the choke lever, during the cold operation of the engine, to the position where the choke valve is at the intermediate degree of opening in operative connection with the throttle lever being pivoted by the governor device to the position where the throttle valve is at the degree of opening for idling or the position in the vicinity thereof, and an intermediate member pivotable relative to the choke lever is disposed between the choke lever and an upper surface of the carburetor body.

5. The carburetor control system according to claim 4, wherein the intermediate member is formed from a collar rotatably fitted to the valve shaft of the choke valve.

* * * * *